US006237573B1

(12) United States Patent
Onishi et al.

(10) Patent No.: US 6,237,573 B1
(45) Date of Patent: May 29, 2001

(54) VARIABLE DELIVERY FUEL SUPPLY DEVICE

(75) Inventors: Yoshihiko Onishi; Masayasu Miyajima, both of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/609,929

(22) Filed: Jul. 5, 2000

(30) Foreign Application Priority Data

Mar. 1, 2000 (JP) ..... 12-055336

(51) Int. Cl.[7] ..... F02M 37/04
(52) U.S. Cl. ..... 123/506; 123/41.31
(58) Field of Search ..... 123/506, 458, 123/41.31, 501, 500

(56) References Cited

U.S. PATENT DOCUMENTS 5,076,241 * 12/1991 Takahashi et al. ..... 123/506
5,201,297 * 4/1993 Eblen et al. ..... 123/502
5,325,838 * 7/1994 Bennett ..... 123/527
5,636,615 * 6/1997 Shorey et al. ..... 123/506
5,639,229 * 6/1997 Cooke ..... 417/440
5,803,049 * 9/1998 Harcombe ..... 123/446
5,924,407 * 7/1999 Idwaszkiewicz et al. ..... 123/41.31
5,975,053 * 11/1999 Rodier ..... 123/446
6,035,828 * 3/2000 Anderson et al. ..... 123/446
6,116,209 * 9/2000 Christ et al. ..... 123/299
6,131,540 * 10/2000 Bronkal ..... 123/41.31

FOREIGN PATENT DOCUMENTS 10-176625 6/1998 (JP) .
11-200990 7/1999 (JP) .

* cited by examiner

*Primary Examiner*—Carl S. Miller
(74) *Attorney, Agent, or Firm*—Sughrue, Mion, Zinn, Macpeak & Seas, PLLC

(57) ABSTRACT

A variable delivery fuel supply device comprising fuel injection valves 1*a* through 1*d* injecting a fuel to cylinders of a combustion engine, a fuel pump 3 taking the fuel in a pressurization chamber 17 from a fuel intake passage 25 through an intake valve 26, pressurizing the fuel, and discharging thus pressurized fuel from a discharge valve 27 by a reciprocal motion of a plunger 15 inside a cylinder, an electromagnetic valve 28, formed in a relief passage 31 connecting the pressurization chamber 17 of the fuel pump 3 to the fuel intake passage 25, for controlling a discharge quantity by relieving the pressurized fuel inside the pressurization chamber 17 at the time of opening the injection valves, and a control means 13 applying a valve-opening signal to the electromagnetic valve 28, wherein a width of a time of the valve-opening signal, applied to the electromagnetic valve 28 from the control means 13, is always set at a constant with respect to a period of the reciprocal movement of the plunger 15, whereby a temperature of a coil can be suppressed without an influence of responsiveness of the electromagnetic valve, and a fuel pressure can be constantly and stably controlled.

2 Claims, 4 Drawing Sheets

VARIABLE DELIVERY FUEL SUPPLY DEVICE

BACKGROUND OF THE INVENTION

1. Field of the Invention

The present invention relates to a variable delivery fuel supply device, which is used for an internal combustion engine, particularly for a cylinder injection type gasoline engine requiring a high pressure fuel, and controls a supply quantity of a fuel, supplied to a fuel injection valve.

2. Discussion of Background

A variable delivery fuel supply device used in a combustion engine for automobiles is constructed by a plurality of fuel injection valves supplying a fuel into cylinders of the combustion engine, a delivery pipe supplying the fuel to these fuel injection valves, a fuel pump supplying the fuel to the delivery pipe after pressurizing the fuel, a low pressure pump supplying the fuel from a fuel tank to the fuel pump, a control means controlling a time of injecting the fuel, an amount of injecting the fuel, a discharge quantity from the fuel pump and so on, and so on. The fuel pump is constructed by a cylinder, a plunger, which is driven by a driving cam, is located in a camshaft of the internal combustion engine, and intakes the fuel into a pressurization chamber in an intake stroke and sends the fuel inside the pressurization chamber to the delivery pipe with pressure in a discharge stroke by reciprocal movements inside the cylinder, and an electromagnetic valve controlling the discharge quantity from the pressurization chamber by relieving the pressurized fuel inside the pressurization chamber at predetermined timing and also controlling a pressure of the fuel in the delivery pipe to be a predetermined pressure.

For example, as disclosed in Japanese Unexamined Patent Publication JP-A-11-200990, ordinarily the electromagnetic valve is constantly closed when a control signal to the electromagnetic valve does not exist in general. The electromagnetic valve is opened in response to a valve-opening signal, received from the control means to relieve the pressurized fuel inside the pressurization chamber on a side of low pressure. The control means further detects the fuel pressure inside the delivery pipe and opens the electromagnetic valve by applying the valve-opening signal in response to a variation of the fuel pressure. Because the fuel pressure inside the delivery pipe is increased in the discharge stroke of the fuel pump, a width of the signal is determined so that the valve-opening signal is applied in a middle of the discharge stroke and the electromagnetic valve is closed when the discharge stroke is completed.

FIG. 4 explains strokes of the fuel pump used in the conventional variable delivery fuel supply device and operating timing of the electromagnetic valve, wherein such a structure is disclosed in, for example, Japanese Unexamined Patent Publication JP-A-11-200990. An amount of piston lift in FIG. 4 is a moving distance of the plunger reciprocating by being driven by a driving cam of the internal combustion engine. A pressurizing stroke is from a bottom dead point to a top dead point. The fuel of a quantity corresponding to in this stroke is pressurized, and sent to the delivery pipes from the pressurization chamber. Further, a stroke from the top dead point to the bottom dead point is an intake stroke, in which the fuel is introduced from the fuel tank into the pressurization chamber.

Strokes A through D in FIG. 4 respectively correspond to each period of strokes in the plunger respectively of the fuel pumps, in which characteristics of the strokes are sampled and shown. Based on FIG. 4, the strokes of the conventional fuel pump and the operation of the conventional electromagnetic valve will be described. The stroke A is a case that only 50% of the total discharge quantity from the fuel pump is discharged, wherein the electromagnetic valve is opened upon receipt of the valve-opening signal at a position of 50% of the discharge stroke of the plunger, and the valve-opening signal is terminated along with completion of the discharge stroke, namely at the top dead point of the plunger, to close the electromagnetic valve. The stroke B is a case that the valve-opening signal is applied when the discharge quantity is 75%, wherein the valve-opening signal is terminated along with the completion of the discharge stroke in a similar manner to that in the stroke A.

The stroke C corresponds to a high-rate low-load in the combustion engine, for example, a case that the discharge amount from the fuel pump is large and a fuel consumption is small such as a state of using an engine brake, wherein the fuel pressure inside the delivery pipe is maintained to a predetermined value. Therefore, the discharge quantity from the fuel pump is 0%, and an amount of relief of the electromagnetic valve is 100%, whereby the valve-opening signal is applied during periods of all strokes of the plunger. The stroke D corresponds to a case that the discharge quantity from the fuel pump is small and the fuel consumption is large, for example, a low-rate large-load of the combustion engine, wherein the valve-opening signal is not applied because the discharge quantity is 100%.

A state that the discharge quantity is 0% or 100% does not highly frequently occur in these strokes. Under an ordinary state, the valve-opening signal is applied on the way of the pressurizing stroke in the plunger and finished at the top dead point. The width of the valve-opening signal is determined by the fuel pressure inside the delivery pipes. Therefore, the width of the signal constantly varies depending on the number of the revolution of the combustion engine and a state of the load for the combustion engine. Further, the width of the valve-opening signal changes in each of the strokes of the plunger even though the number of revolution and the load are constant. The control means operates the valve-opening time and the width of the valve-opening signal in each of the strokes and provides results to the electromagnetic valve.

Although, in the conventional variable delivery fuel supply device, the above-mentioned valve-opening signal is applied to the electromagnetic valve, in cases that a rise-up time of the fuel pressure inside the delivery pipe to a predetermined pressure is relatively large, for example, just after starting the combustion engine, and the fuel consumption is relatively large in comparison with the discharge quantity from the fuel pump, a time that the fuel pressure reaches the predetermined value may become very short just before the plunger passes through the top dead point, wherein the valve-opening signal becomes a pulse signal for a short time.

Meanwhile, because responsiveness of the electromagnetic valve to the valve-opening signal is limited, the electromagnetic valve can not follow the short-time pulse signal, whereby there is a case that the control becomes impossible and the fuel pressure in the delivery pipe becomes unstable. Especially, when the combustion engine is operated at a high revolution number, a time required for strokes in the plunger is shortened, and therefore the signal width of the valve-opening signal is shortened, whereby the responsiveness of the electromagnetic valve limits a maximum revolution rate of the fuel pump.

Further, because the control unit is suffered from dispersion in its control, the valve is occasionally closed in the discharge stroke before the top dead point of the plunger in the conventional control method, whereby there is a problem that the fuel pressure inside the delivery pipe becomes higher than the predetermined value by repeated discharges from the fuel pump. Further, under the high-rate small-load condition, for example, in using the compression brake in the combustion engine, there is a case the fuel consumption is sufficiently small with respect to the discharge quantity from the fuel pump, and therefore the discharge quantity is maintained to be 0%. In this case, an electric current to a coil of the electromagnetic valve becomes 100%. Because a resistance of the coil is set small to improve the responsiveness of the electromagnetic valve, there is a problem that a temperature of the coil is abnormally increased. In order to suppress the temperature increment, it is necessary to increase the resistance of the coil of the electromagnetic valve, whereby the responsiveness of the electromagnetic valve is further spoiled.

SUMMARY OF THE INVENTION

It is an object of the present invention to solve the above-mentioned problems inherent in the conventional technique and to provide a variable delivery fuel supply device, which can constantly and stably control a fuel pressure without influences of responsiveness and dispersion of control in an electromagnetic valve, and does not make a temperature of a coil abnormally increase.

According to a first aspect of the present invention, there is provided a variable delivery fuel supply device comprising: fuel injection valves injecting a fuel to cylinders of a combustion engine; a delivery pipe supplying the fuel, being pressurized, to the fuel injection valves; a fuel pump taking the fuel from a fuel intake passage through an intake valve to a pressurization chamber, pressurizing the fuel, and discharging the pressurized fuel through a discharge valve to the delivery pipe by reciprocal movement of the plunger inside a cylinder; an electromagnetic valve, which is located in a relief passage connecting pressurization chamber of the fuel pump to the fuel intake passage to control a discharge quantity of the pressurized fuel by relieving the pressurized fuel inside the pressurization chamber to the fuel intake passage at time of opening the valve; and a control means applying a valve-opening signal to the electromagnetic valve, wherein a time width of the valve-opening signal applied to the electromagnetic valve from the control means is set to have a constant rate with respect to a period of reciprocal movement of the plunger.

According to a second aspect of the present invention, there is provided the variable delivery fuel supply device, wherein the time width of the valve-opening signal is set 50% of the period of the reciprocal movement of the plunger.

BRIEF DESCRIPTION OF THE DRAWINGS

A more complete appreciation of the invention and many of the attendant advantages thereof will be readily obtained as the same becomes better understood by reference to the following detailed description when considered in connection with the accompanied drawings, wherein.

DETAILED DESCRIPTION OF THE PREFERRED EMBODIMENTS

A detailed explanation will be given of preferred Embodiments of the present invention in reference to FIGS. 1 through 3 as follows, wherein the same numerical references are used for the same or similar portions and description of these portions is omitted.

Embodiment 1

Figure 1:
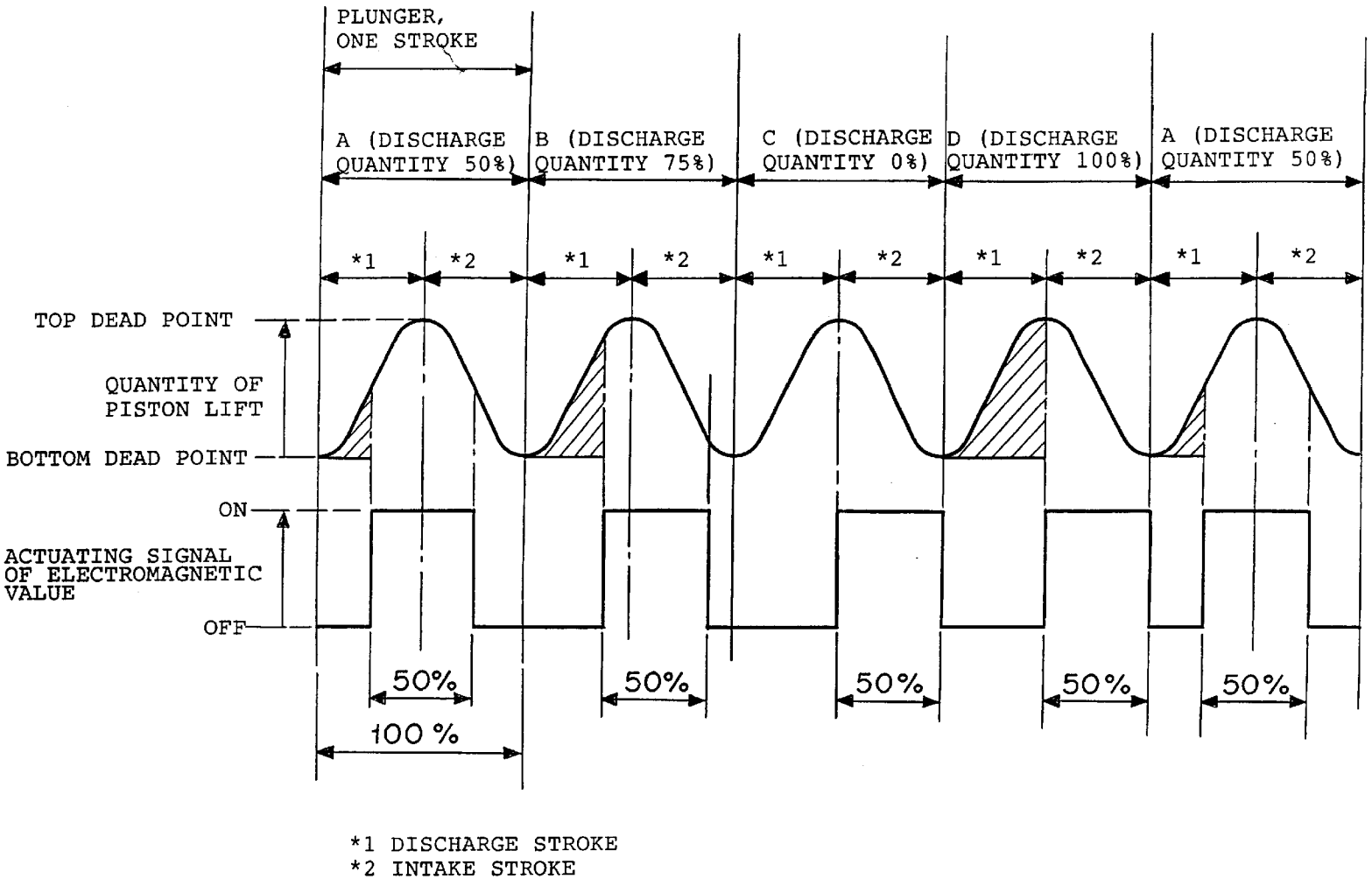
FIG. 1 explains an operation of the variable delivery fuel supply device according to Embodiment 1 of the present invention.

FIG. 1 explains operation timing of a fuel pump of a variable delivery fuel supply device and an electromagnetic valve according to Embodiment 1 of the present invention. FIG. 2 is a system chart illustrating the variable delivery fuel supply device. FIG. 3 is a cross-sectional view of the fuel pump. In FIG. 2, numerical references 1*a* through 1*d* designate fuel injection valves, respectively provided in cylinders of a combustion engine; numerical reference 2 designates a delivery pipe holding a fuel, being pressurized, and supplying the fuel to the fuel injection valves 1*a* through 1*d*; numerical reference 3 designates the fuel pump supplying the pressurized fuel to the delivery pipe 2 through a fuel passage; numerical reference 4 designates a low-pressure fuel pump supplying the fuel from the fuel tank 5 through a fuel passage 7 to the fuel pump; numerical reference 6 designates a check valve, located in the fuel passage 7, for maintaining a fuel pressure inside the fuel passage 7 for a predetermined time; numerical reference 8 designates a low-pressure regulator controlling a pressure inside the fuel passage when the engine is stopped; numerical reference 8 designates a low-pressure regulator controlling a pressure inside the fuel passage 7; numerical reference 9 designates a check valve relieving the fuel toward the fuel tank 5 from the fuel passage 10 through a fuel passage 11; numerical reference 12 designates a return passage returning the fuel from the pressure pump to the fuel tank 5; and numerical reference 13 designates a control means for controlling a fuel pressure.

Figure 2:
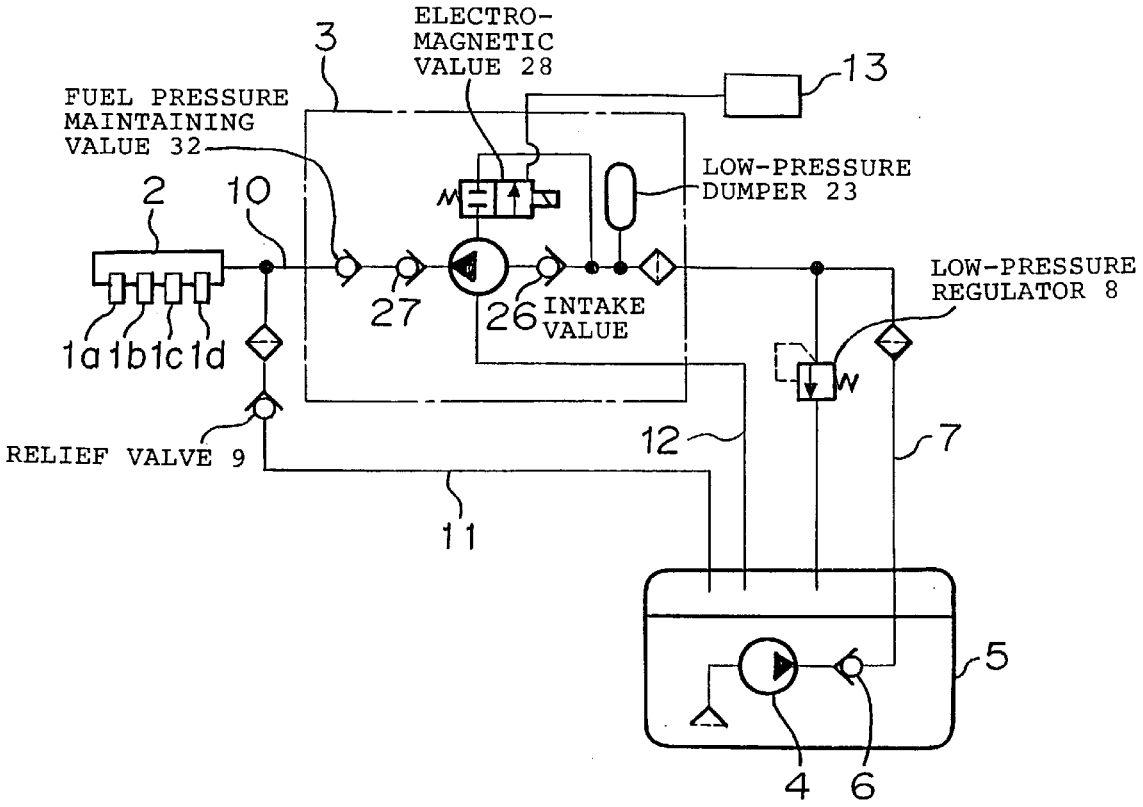
FIG. 2 is a system chart illustrating a structure of the variable delivery fuel supply device according to Embodiment 1 of the present invention.
Figure 3:
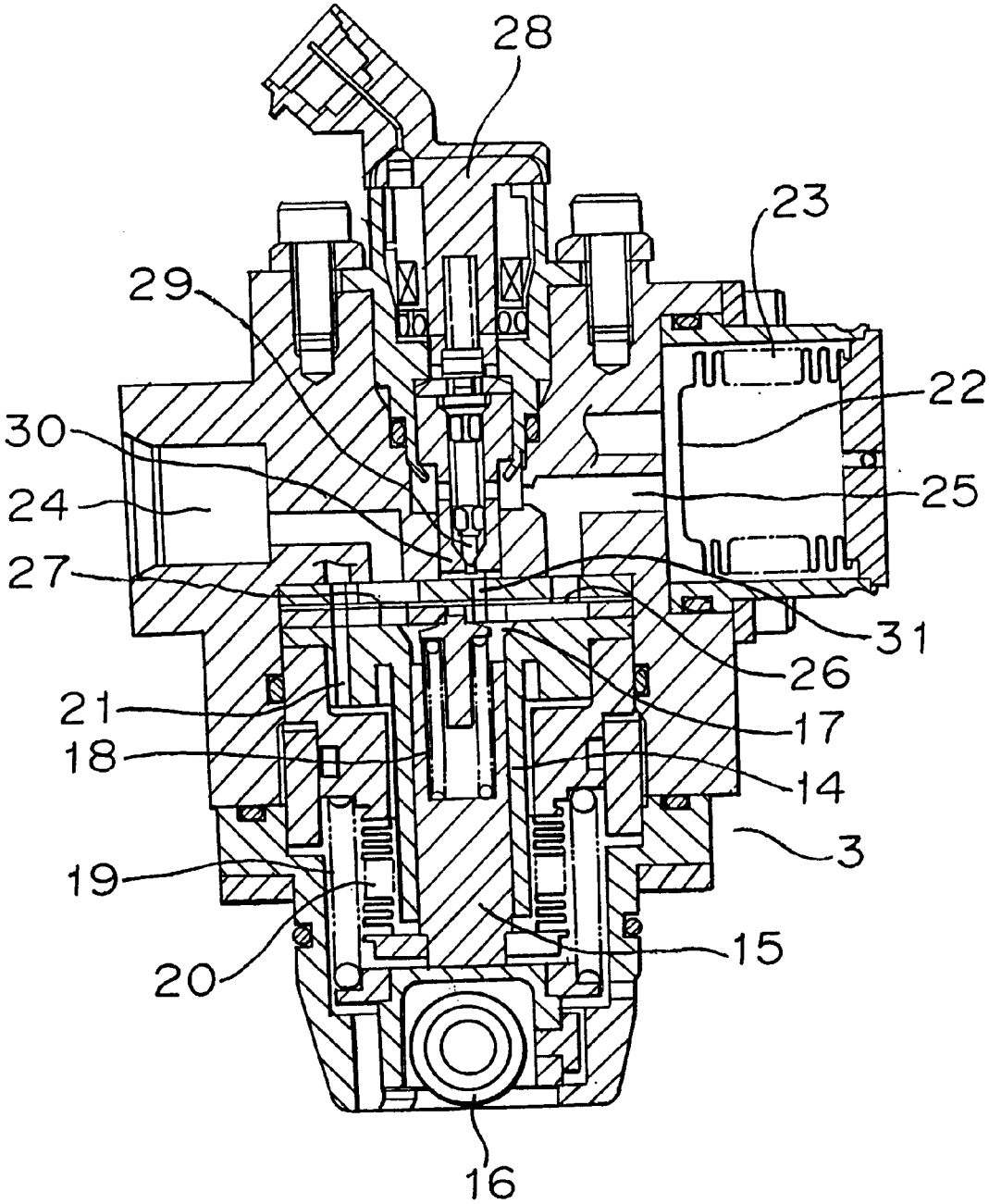
FIG. 3 is a cross-sectional view illustrating a structure of a fuel pump used in the variable delivery fuel supply device according to Embodiment 1 of the resent invention.
Figure 4:
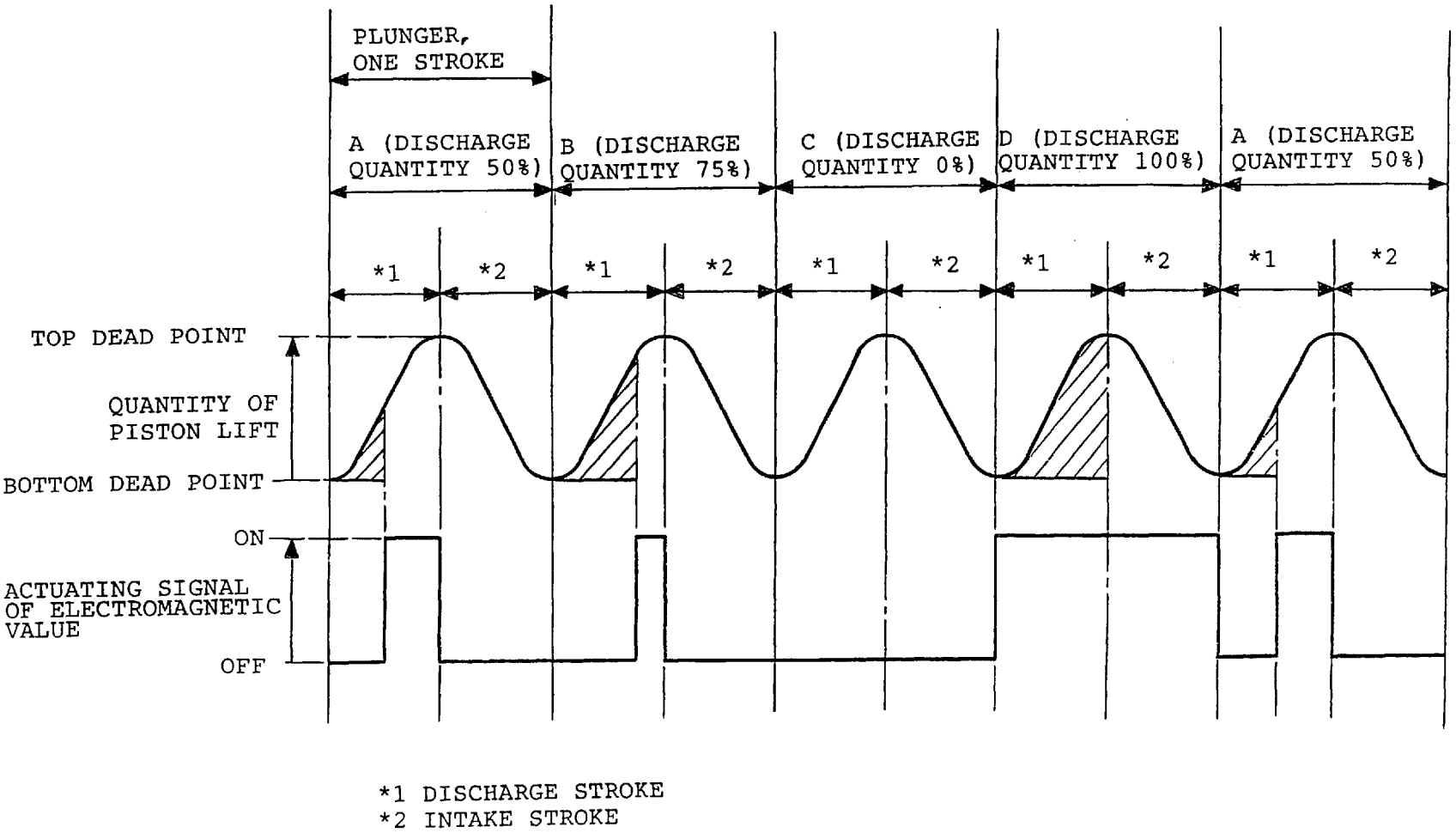
FIG. 4 explains an operation of a conventional variable delivery fuel supply device.

In the fuel pump 3 illustrated in FIG. 3, numerical reference 14 designates a cylinder; numerical reference 15 designates a plunger, which is actuated by an actuating cam of a camshaft (not shown) through a roller 16, and takes the fuel inside the pressurization chamber 17 by reciprocally moving inside the cylinder 14 to pressurize the fuel; numerical reference 18 designates a spring constantly urging the plunger 15 in a direction of expanding the pressurization chamber 17; numerical reference 19 designates a spring urging the roller 16 on a side of the camshaft (not shown); and numerical reference 20 designates a metallic bellows sealing the fuel leaking between the cylinder 14 and the plunger 15, wherein the fuel leaked inside the metallic bellows 20 is returned to the fuel tank 5 through a return passage 21 and a return passage 12 in FIG. 2. Numerical reference 22 designates a fuel intake port having a low-pressure damper. Numerical reference 24 designates a fuel discharge port, connected to the delivery pipe 2 through the fuel passage. The fuel intake port 22 is connected to the pressurization chamber 17 through a fuel passage 25 and an intake valve 26, formed by a check valve such as a read valve, wherein the fuel discharge port 24 is connected to the pressurization chamber 17 through a discharge valve 27.

Numerical reference 28 designates an electromagnetic valve, ordinarily closed and opened by a valve-opening signal from the control means 13. A valve constructed by a valve body 29 and a valve seat 30 is formed to open and close a relief passage connected to the fuel intake passage 25 from the pressurization chamber 17, wherein the pressurized fuel inside the pressurization chamber 17 is relieved to the fuel intake passage 25 when the electromagnetic valve 28 is opened. The fuel pump 3 is located inside the combustion engine, driven by a cam for actuating the pump, which cam is formed in the camshaft of the combustion engine, pressurizes the fuel along with a rotation of the combustion engine, and sends the pressurized fuel into the delivery pipe 2. A rate of the rotation of the combustion engine, a rotational angle of the camshaft, the fuel pressure inside the delivery pipe 2, and so on are inputted from sensors (not shown) into the control means 13, whereby the control means 13 provides the valve-opening signal to the electromagnetic valve 28.

In this variable delivery fuel supply device according to Embodiment 1 of the present invention, when a key switch of the combustion engine is turned on, the low-pressure fuel pump 4 electrically driven is actuated to supply the fuel from the fuel tank 5 to the fuel pump 3. Succeedingly, the fuel pump 3 is driven along with a starting operation of the combustion engine. The discharge valve 27 is closed and the intake port 26 is opened in the intake stroke of the plunger 15, whereby the fuel is introduced into the pressurization chamber 17 through the fuel intake port 22 and the fuel intake passage 25. In the discharge stroke of the plunger 15, the intake valve 26 is closed and the discharge valve 27 is opened, whereby the pressurized fuel is sent with a pressure from the fuel discharge port 24 through the fuel passage 10 to the delivery pipe 2. Although, the fuel pressure inside the fuel pump 3 is decreased when the engine is stopped, the fuel pressure inside the delivery pipe 2 is maintained for a predetermined time upon a closing movement of a fuel pressure maintaining valve 32.

The reciprocal movement of the plunger 15 is made faster as the rate of revolution of the combustion engine is increased. When the fuel pressure inside the delivery pipe 2 reaches a predetermined value, the control means 13 detects this, applies the valve-opening signal to the electromagnetic valve 28, making the pressurization chamber 17 having a high fuel pressure connect to the fuel intake passage 25 having a low fuel pressure by opening the valve, and relieves the fuel to stop force feed of the fuel from the pressurization chamber 17 to the delivery pipe 2, whereby the fuel pressure inside the delivery pipe 2 is constantly maintained. Control operation of the control means 13 is conducted as follows.

FIG. 1 illustrates a content of the control operation. The valve-opening signal from the control means 13 is constantly a predetermined value with respect to a period of the strokes of the plunger 15 in the fuel pump 3, for example, 50% as an electromagnetic valve actuating signal. Timing for starting to open the valve, i.e. rise timing of the electromagnetic valve actuating signal is set so as to control the pressure inside the delivery pipe. Specifically, when the fuel pressure inside the delivery pipe 2 reaches the predetermined pressure by discharging 50% of a full stroke of the plunger 15, the valve-opening signal rises at a position of 50% of the stroke between the bottom dead point and the top dead point of the plunger 15 to open the electromagnetic valve 28, and the electromagnetic valve 28 is closed after a time corresponding to 50% of the stroke period, calculated by the number of revolution, of the plunger 15, as in a stroke A of FIG. 1. Because a time for discharging by the plunger is between the bottom dead point and the top dead point, the relief of the fuel is 50% of a full stroke.

Further, in case that the fuel pressure inside the delivery pipe 2 satisfies the predetermined value, and the discharge quantity is allowed to be 0%, the electromagnetic valve 28 is opened between the bottom dead point and the top dead point of the plunger 15 as in a stroke C of FIG. 1, whereby the fuel is relieved during an entire pressurizing stroke. In case that the fuel pressure inside the delivery pipe 2 is low, and the discharge quantity is necessary to be 100%, the electromagnetic valve 25 is opened between the top dead point and the bottom dead point of the plunger 15 as in a stroke D, whereby the relieving quantity of the fuel is 0%. The rise timing of the valve-opening signal is continuously changed between the bottom dead point and the top dead point of the plunger in response to the fuel pressure inside the delivery valve 2. The valve-opening time is controlled so as to be constantly fixed to 50% of a stroke time of the plunger 15.

By setting the control operation as described above, the valve-opening time can be determined based on only the rate of revolution of the combustion engine irrespective of the discharge quantity and the discharge pressure. Therefore, only the rise timing of the valve-opening signal is controlled, whereby a content of the control is simplified. Further, by thus setting the width of the pulse time of the actuating signal, an actuating pulse width is constantly 50% of the stroke period even though the discharge quantity is relatively large. Accordingly, there is no valve-opening signal having a short time pulse, whereby nonuniformity of the discharge quantity, caused by responsiveness of the electromagnetic valve does not occur; the fuel pressure inside the delivery pipe is constantly maintained to be the predetermined value; it becomes possible to use an electromagnetic valve having insufficient responsiveness; and the fuel pump can be controlled in a range of a further high rate of revolution, in which region the responsiveness of the electromagnetic valve in the conventional technique is limited. Further, by setting the valve-opening time at least 50% of the stroke period of the plunger, the discharge quantity can be controlled from 0 to 100%.

The first advantage of the variable delivery fuel supply device according to the present invention is that the control is simplified, and the fuel pressure is stabilized.

The second advantage of the variable delivery fuel supply device according to the present invention is that a temperature increment can be suppressed, and the device can be freely designed.

The third advantage of the variable delivery fuel supply device is that the fuel pump can be controlled at a further high rate of revolution region, and the fuel pump can be operated at a high rate.

What is claimed is:

1. A variable delivery fuel supply device comprising:

fuel injection valves injecting a fuel to cylinders of a combustion engine;

a delivery pipe supplying the fuel, being pressurized, to said fuel injection valves;

a fuel pump taking the fuel in a pressurization chamber from a fuel intake passage through an intake valve, pressurizing the fuel, and discharging thus pressurized fuel from a discharge valve to said delivery pipe by a reciprocal motion of a plunger inside a cylinder;

an electromagnetic valve, formed in a relief passage connecting said pressurization chamber of said fuel pump to said fuel intake passage, for controlling a discharge quantity by relieving said pressurized fuel in said pressurization chamber at time of opening said injection valves; and a control means applying a valve-opening signal to said electromagnetic valve, wherein a time width of said valve-opening signal, applied to said electromagnetic valve from said control means is always set at a constant width with respect to a period of the reciprocal movement of said plunger.

2. The variable delivery fuel supply device according to claim 1, wherein said time width of said valve-opening signal is 50% of said reciprocal period of said plunger.

* * * * *